US007207156B2

(12) United States Patent
Metzger

(10) Patent No.: US 7,207,156 B2
(45) **Date of Patent: *Apr. 24, 2007**

(54) ICE BAGGING APPARATUS AND METHOD

(75) Inventor: Mark C. Metzger, Glendale, AZ (US)

(73) Assignee: ICEX Holdings, Ltd., Inc., Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/886,223

(22) Filed: Jul. 6, 2004

(65) Prior Publication Data

US 2006/0005564 A1 Jan. 12, 2006

(51) Int. Cl.
*B65B 43/00* (2006.01)

(52) U.S. Cl. ..... 53/440; 53/459; 53/127; 53/570

(58) Field of Classification Search ..... 53/440, 53/459, 127, 570
See application file for complete search history.

(56) References Cited

U.S. PATENT DOCUMENTS

| | | | | |
|---|---|---|---|---|
| 3,712,019 | A | 1/1973 | Lamka et al. | |
| 3,789,570 | A | 2/1974 | Mullins, Jr. | |
| 3,807,193 | A | 4/1974 | McKenney et al. | |
| 3,897,676 | A | 8/1975 | Membrino | |
| 3,918,266 | A | 11/1975 | Gindy et al. | |
| 4,013,199 | A * | 3/1977 | Brown | 222/438 |
| 4,132,049 | A | 1/1979 | Mullins, Jr. | |
| 4,348,872 | A | 9/1982 | Hill | |
| 4,368,608 | A | 1/1983 | Ray | |
| 4,689,937 | A * | 9/1987 | Finan et al. | 53/502 |
| 5,088,300 | A * | 2/1992 | Wessa | 62/340 |
| 5,109,651 | A | 5/1992 | Stuart | |
| 5,277,016 | A * | 1/1994 | Williams et al. | 53/459 |
| 5,458,851 | A | 10/1995 | Schroeder et al. | |
| 5,473,865 | A * | 12/1995 | Tanaka et al. | 53/502 |
| 5,581,982 | A | 12/1996 | Schroeder et al. | |
| 5,630,310 | A * | 5/1997 | Chadwell | 53/502 |
| 6,112,539 | A * | 9/2000 | Colberg | 62/331 |
| 6,266,945 | B1 | 7/2001 | Schroeder | |
| 6,354,338 | B1 | 3/2002 | Takemoto | |
| 6,474,048 | B1 | 11/2002 | Metzger et al. | |
| 6,827,529 | B1 * | 12/2004 | Berge et al. | 406/28 |
| 6,904,946 | B2 * | 6/2005 | James | 141/313 |

* cited by examiner

*Primary Examiner*—John Sipos
(74) *Attorney, Agent, or Firm*—The Matthews Firm

(57) ABSTRACT

An apparatus and method for bagging ice. The apparatus comprises an ice maker for making ice and a hopper for receiving for receiving the ice from the ice maker. The apparatus further includes a roller drum, operatively associated with the hopper, for measuring the ice and delivering of the ice. A bag delivery mechanism for placing the ice in a bag is also included, with the bag delivery mechanism including a bag supply mechanism, a blower fan engaged to open the mouth of the bag to receive the product, and a heat sealer that seals the open mouth of the bag once the bag is filled with the ice. A control device is included that manages and monitors the roller drum and bag delivery mechanism and allows transmission of the collected data to the internet.

7 Claims, 4 Drawing Sheets

ICE BAGGING APPARATUS AND METHOD

BACKGROUND OF THE INVENTION

This invention relates to an ice bagging apparatus. More specifically, but not by way of limitation, this invention relates to an ice bagging apparatus, method of using the apparatus, and the process of remotely monitoring the apparatus from a remote location.

The production of ice for consumer consumption is a major industry. Consumers require ice for drinks, ice chest, refrigeration, etc. Typical ice production requires the use of an ice maker that deposes of the ice into bags. The bags of ice are then stacked into a freezer. The bags can then be retrieved from the freezer by users.

In the retail business, many times the bags of ice are delivered to the store site. A freezer, located at the retail business, will store the bags of ice. Hence, theses prior art devices require that the ice maker and the dispenser (freezer) be separate. The separation of the ice maker and freezer leads to many problems, including but not limited to transportation, inadequate inventory, time delivery problems, etc.

Some prior art devices have attempted to locate the ice maker and the dispenser in one unit and wherein the dispenser is located at the retail site. However, these prior art devices have had many problems. For instance, if the device is in a retail establishment and the device develops a problem, the employees of the retail establishment have no expertise in repairing the device. Additionally, these prior art devices have been unreliable in their attempt to automate the process due to the numerous cooperating components. For instance, during the bagging process, the ice can bridge thereby effectively halting the placement of ice into the bags. Therefore, there is a need for a device that can produce and dispense of the ice in a single unit. There is also a need for an apparatus that can operate autonomously. Additionally, there is a need for a device that will collect information regarding the production of ice, and reliably store and report that information to a remote location. These needs, as well as many others, will be met by the herein described invention.

SUMMARY OF INVENTION

Briefly described, in a preferred embodiment, the present invention overcomes the above-mentioned disadvantages and meets the recognized need for such a device by providing an ice-bagging apparatus and method that provides an establishment with the ability to automatically and expeditiously produce, bag and store bags of ice, thus maintaining a desired supply of bagged ice by eliminating conventional methods of manual ice bagging and reducing the likelihood of unwanted bridging of the ice particles/cubes.

According to its major aspects and broadly stated, the present invention in its preferred form is an ice-bagging apparatus having an ice maker and a hopper for receiving ice from the ice maker. A roller drum measuring and delivery system, a bagging mechanism for bagging the ice, a freezer for storing the bagged ice and a control panel for managing and monitoring the system is included.

More specifically, the present invention is an ice bagging apparatus having an ice maker, a hopper for receiving ice from the ice maker, a roller drum that measures the amount of ice to be bagged and delivers the ice to the opened bag wherein the bag is fed through the apparatus via a bag supply mechanism. Once the drum is filled with the desired amount of ice, the roller drum rotates through a computer programmed/electronically controlled to position itself over the bag. A blower fan is engaged to open the mouth of the bag to receive the product. The ice is then dumped into the waiting bag. The filled bag is then heat sealed using a heat seal strip. The sealed bag is then rotated out of the heat seal operation and dumped into a freezer/storage unit. The entire process is fully automated and/or computer controlled.

The invention possesses laser switches positioned at specific areas on the machine for reading the process at various stages to properly time the sequence of operation. Additional sensors are used to read a signal code on the furnished bags ensuring only a select type of bag/brand can be used.

If the equipment encounters a problem, the electronics provided with the equipment will attempt to correct the problem. If the electronics provided cannot correct the problem, a signal is sent via a telecommunication means to a web site for assistance in repairing the malfunction. This web site also gathers information such as number of bags utilized, number of cycles or volume of ice produced.

In one preferred embodiment, a process of bagging ice with an ice bagging apparatus is disclosed. The process comprises making ice and channeling the ice to a hopper then to a roller drum. Next, the amount of ice is measured in the roller drum and a bag is supplied via a bag supply mechanism. The process includes rotating the roller drum to a position over the bag once the roller drum is filled with the desired amount of ice. An open mouth of the bag is engaged with a blower fan and the bag is blown open with the blower fan. The ice is dumped into the waiting bag and the bag is heat sealed with a heat seal strip. The sealed bag is rotated into a freezer/storage unit.

The process may further include placing a plurality of laser switches at specific areas on the apparatus for reading the process at various stages to properly time the sequence of operation, and placing sensor means to read a signal code on the furnished bags from a bag supply mechanism in the ice bagging apparatus. The process may further include reading the sensor means with a control unit means, the control unit means being operatively associated with the ice bagging apparatus, and storing the information obtained from the laser switches and sensor means within the control means. Next, the information is transmitted to a web page accessible on the internet and remote users may monitor the information found on the web page for ensuring production of ice bags, for reporting, and for regular maintenance.

An advantage of the invention is its ability to continuously and automatically produce bags of ice, thus maintaining a desired supply of bagged ice. Another advantage is that the apparatus has the ability to send and receive computer signals for regular maintenance and reporting. Yet another advantage is that the equipment drains water as it is produced from ice maker to eliminate the potential problem of bridged ice in the bagging process. Another advantage is that the equipment functions without the use of augers as utilized in prior art machines. The apparatus eliminates the possibility of bridged ice and increases production rates.

Yet another advantage is that the apparatus and process will reduce a vendor's overall cost of bagged ice. Still yet another advantage is the apparatuses electronic ability to attempt to correct problems associated with its components and/or machine parts. If the problems cannot be corrected internally, a signal is sent for further assistance in remedying the problem through its global networking system.

A feature of the invention is that the apparatus has the ability to police the selection and brand of bag being used. If the particular bag being used is not approved, the machine will not function. Another feature is that the apparatus is designed to utilize less space than prior art machines giving customers more costly floor space in their stores for displaying other merchandise. Another feature is that the apparatus has the ability to open mechanically a bag during the process of filling with ice. Still yet another feature is the ability to agitate ice held in hopper prior to bag filling to eliminate the possibility of bridging.

These and other objects, features and advantages of the present invention will become more apparent to one skilled in the art from the above description and claims when read in light of the accompanying drawings.

DETAILED DESCRIPTION OF THE PREFERRED EMBODIMENTS

Figure 1:
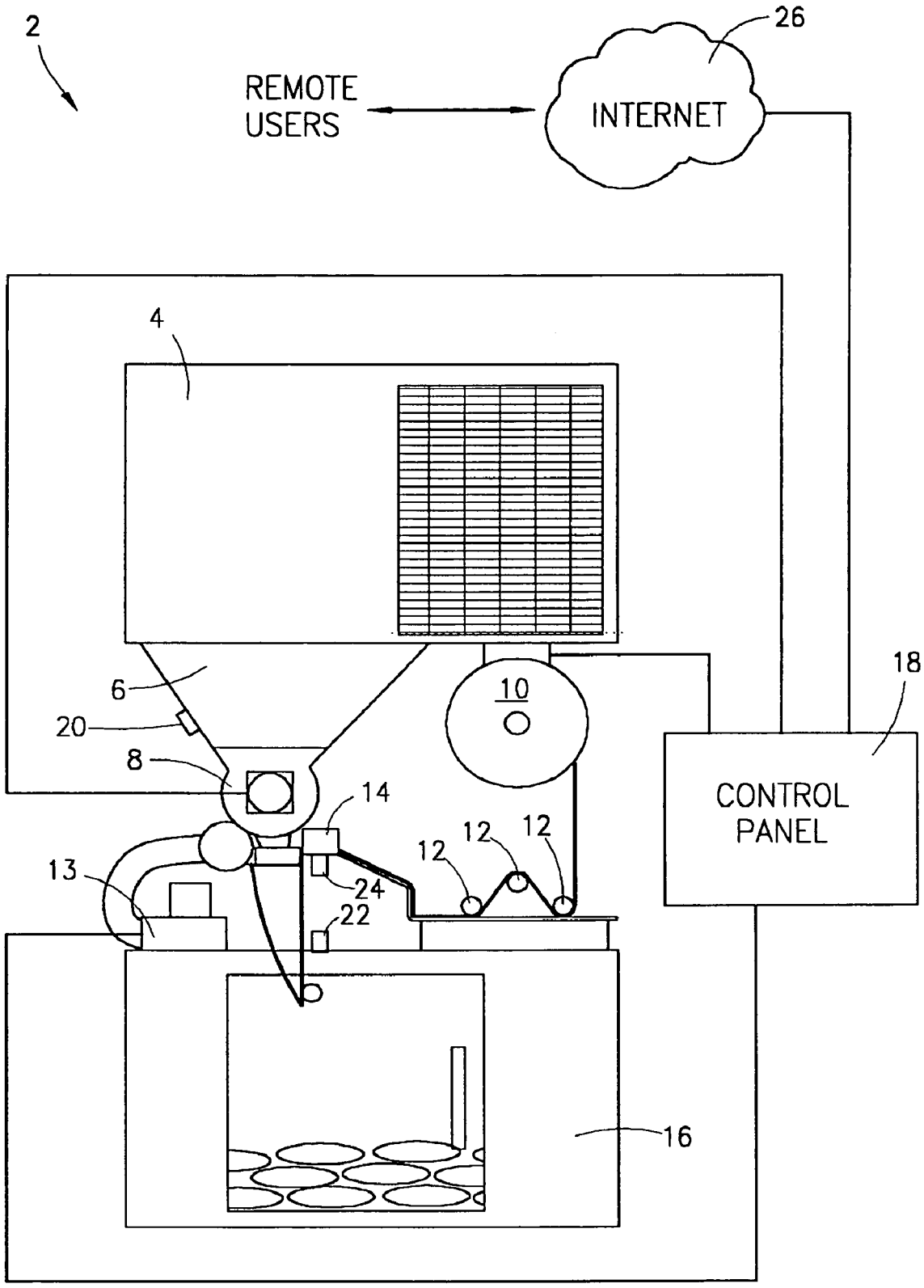
FIG. 1 is a schematic illustration of the ice bagging apparatus and system.

Referring now to FIG. 1, a schematic illustration of the ice bagging apparatus and system 2 will now be described. 1. The apparatus 2 includes an ice maker 4 for making ice, and wherein the ice maker 4 will be operatively associated with a hopper 6 for receiving for receiving the ice from the ice maker. A roller drum means 8, operatively associated with the hopper 6, for measuring ice and delivering of the ice is included.

The apparatus 2 also includes a bagging means, operatively receiving the ice from the roller drum means, for placing the ice in a bag. The bagging means includes a bag supply mechanism that includes a cylinder 10 containing rolled up plastic bags, a roller bar system, seen generally at 12, that are used for advancing the bags from the cylinder 10, a blower fan 13 engaged to open the mouth of the bag to receive the product, and a heat sealer means 14 for heat sealing the open mouth of the bag once the bag is filled with the ice.

The apparatus 2 further contains a freezer 16 for storing the bagged ice, so that after the ice is dumped into the opened ice bag, and then heat sealed, the bag is then cut and placed into the freezer 16. FIG. 1 further depicts control means 18 for managing and monitoring the roller drum means 8, the cylinder 10, and the bagging means.

In one preferred embodiment, the control means 18 includes laser switches, seen generally at 20, 22, 24 for reading the process at various stages to properly time the sequence of operation of the ice bagging. The information collected via the laser switches is sent to the control means for storage and processing. Also, the bags may include a signal code containing identifying information and wherein the control means further includes means for reading the signal code on the bag ensuring only a select type of bag can be used.

In the preferred embodiment, the control means 18 further comprises means for storing the information obtained from the laser switches and sensor means is provided, and wherein the storing means is operatively associated with the control means, and means for transmitting the information to a web page accessible on the internet 26. Hence, remote users can then log onto the internet, and monitor the entire ice making, bagging and distribution. The remote users can also attempt to trouble shoot problems based on the diagnostic data that has been collected via the control means 18.

Figure 2:
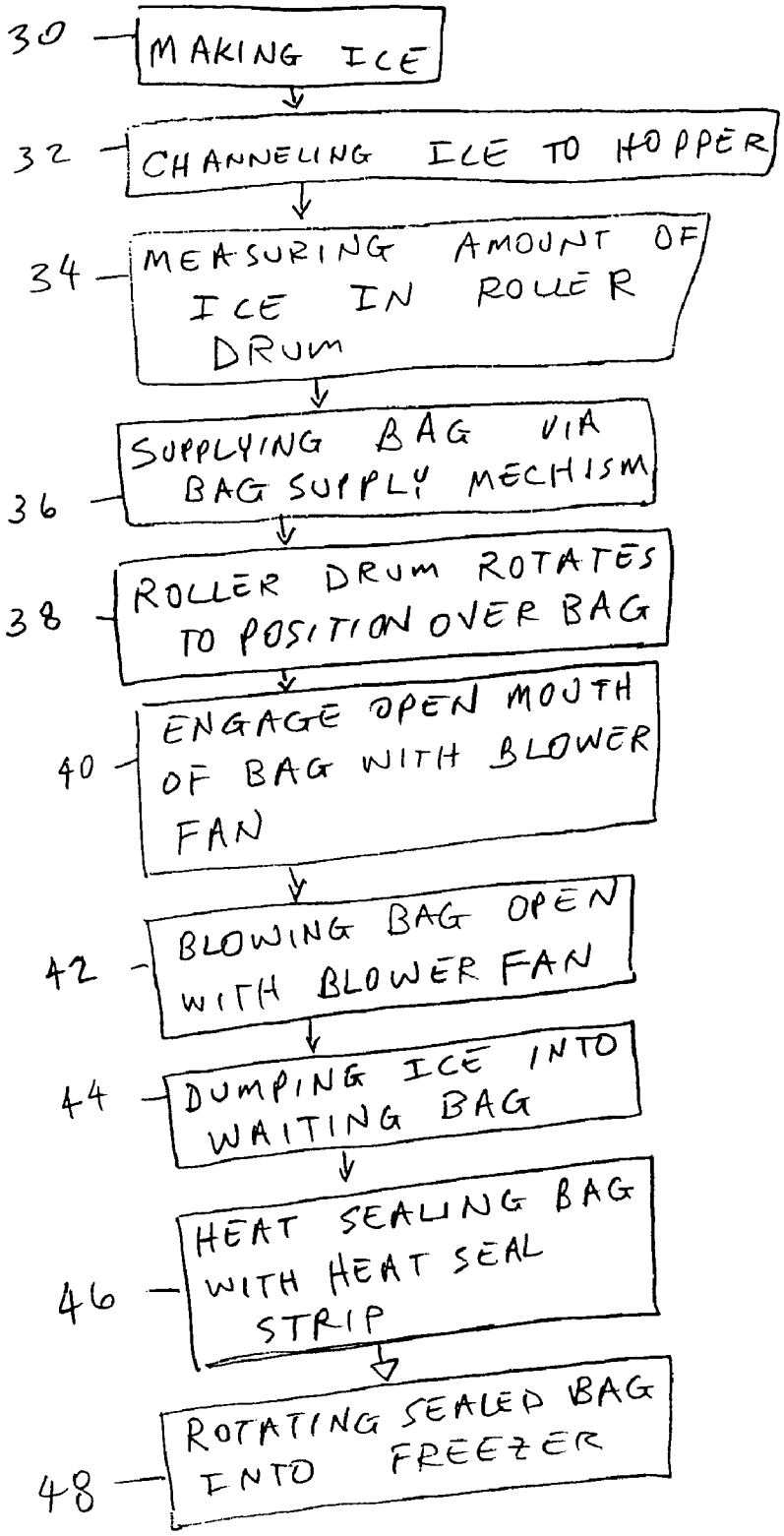
FIG. 2 is a flow chart of the ice bagging process.

Referring now to FIG. 2, a flow chart of the ice bagging process will now be described. First, ice is made with the ice maker (step 30), and then ice is channeled to the hopper (step 32). The amount of ice is measured in the roller drum (step 34). A bag is then supplied via a bag supply mechanism (step 36). Once the roller drum is filled with desired amount of ice, the roller drum rotates to position over the bag (step 38). Next, an open mouth of the bag is engaged with a blower fan (step 40), and the bag is blown open with the blower fan 42. The ice is dumped into the waiting bag (step 44) and then the bag is heat sealed with a heat seal strip (step 46). Next, the sealed bag is rotated into a freezer/storage unit (step 48).

Figure 3:
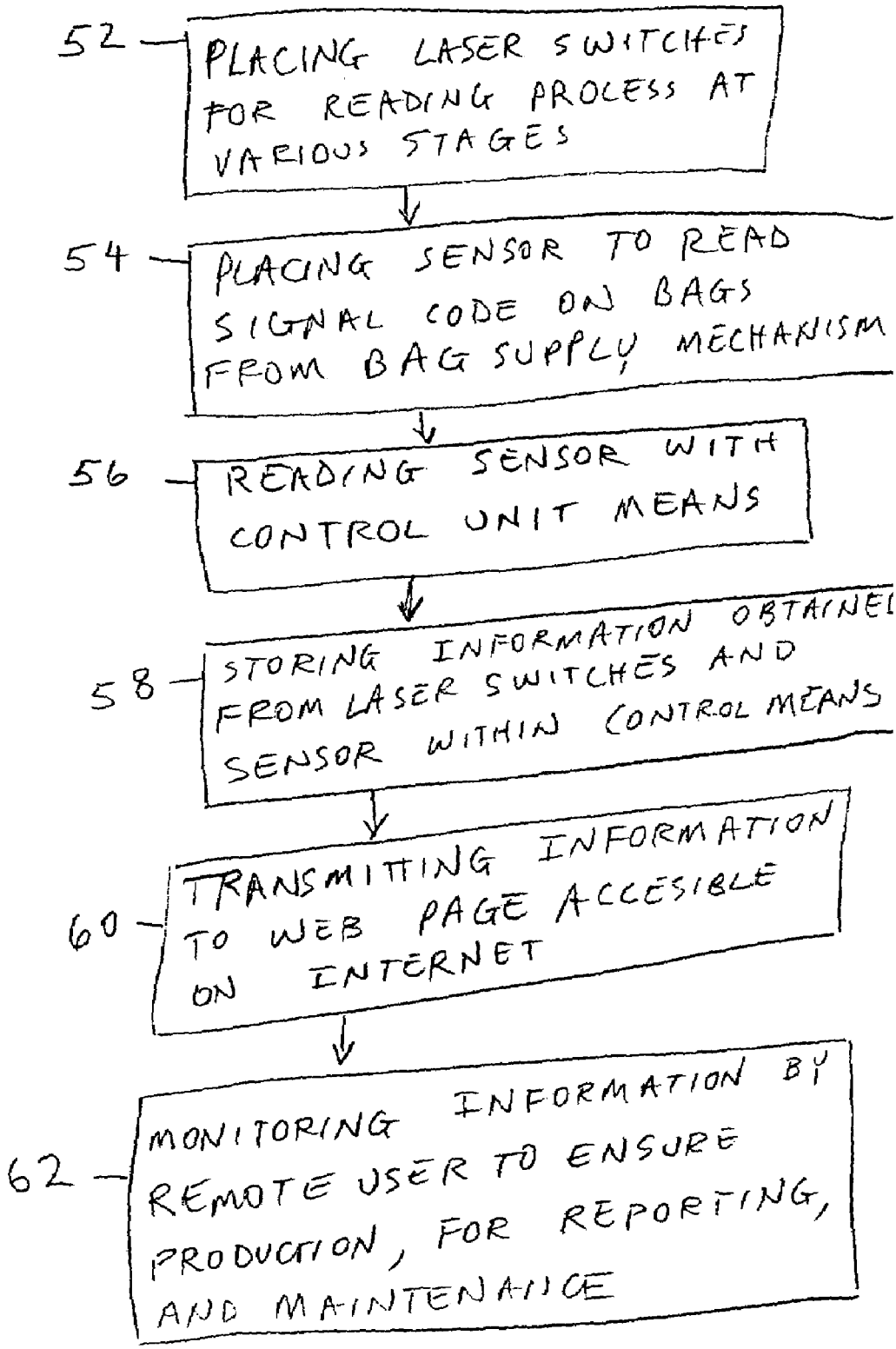
FIG. 3 is a flow chart of the control unit operation and process.

FIG. 3 is a flow chart of the control unit operation and process. The process includes placing laser switches at specific areas for reading the process at various stages to properly time the sequence of operation (step 52), and placing sensor means to read a signal code on the furnished bags from the bag supply mechanism (step 54). The process further includes reading the sensor with the control unit means, located on the apparatus (step 56) and storing the information obtained from the laser switches and sensor means within the control means (step 58). Next, the process includes transmitting the information to a web page accessible on the internet (step 60) and monitoring the information found on the web page by a remote user to ensure production of ice bags, for reporting, and regular maintenance (step 62).

Figure 4:
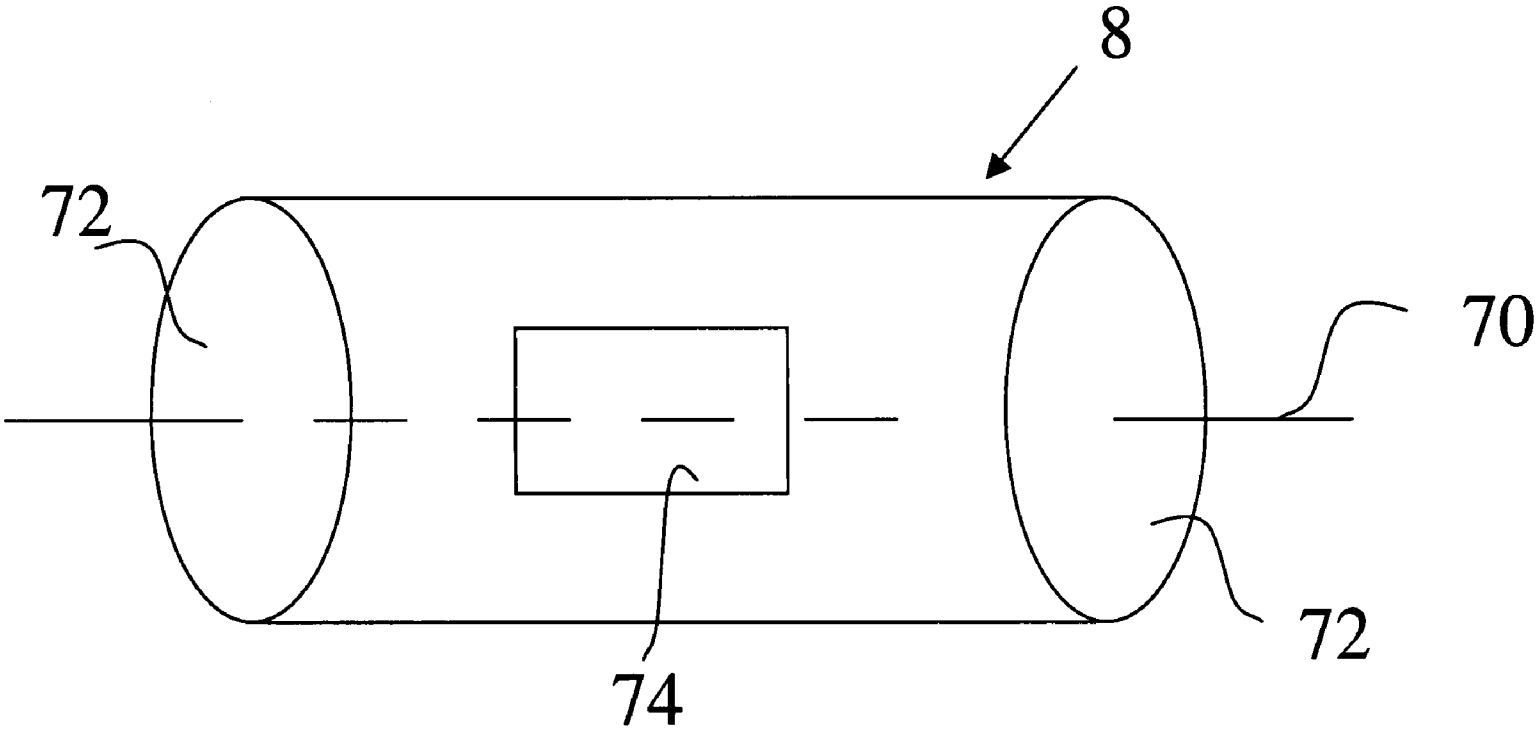
FIG. 4 is an illustration of the roller drum for the ice bagging apparatus and system.

FIG. 4 illustrates the roller drum 8. Roller drum 8 is preferably horizontally mounted, as illustrated in FIG. 1, has a longitudinal axis 70, two sealed ends 72, and an opening 74, which is substantially parallel to the longitudinal axis.

The foregoing has been illustrative of the features and principles of the present invention. Changes and modifications in the specifically described embodiments can be carried out without departing from the scope of the invention which is intended to be limited only by the scope of the appended claims and any equivalents thereof.

I claim:

1. An apparatus for bagging ice comprising:

an ice maker for making ice;

a hopper for receiving the ice from the ice maker;

a single roller drum mounted along a horizontal longitudinal axis below and, operatively associated with the hopper;

said single roller drum further having a wall defining an interior for carrying a pre-determined amount of ice therein and an opening for receiving and dispensing ice, wherein only the said single roller drum measures ice and delivers ice, and wherein said ice is contained within said single roller drum prior to said dispensing, and wherein said single roller drum rotates about its longitudinal axis to receive and deliver ice;

an automatic bagger, operatively receiving the ice from the single roller drum, for placing the ice in a bag;

a freezer for storing the bagged ice; and, a processor for managing and monitoring the single roller drum and bagger, wherein said processor positions said single roller drum opening to be in alignment with said hopper when receiving ice and in alignment with said bagger when dispensing ice.

2. The apparatus of claim 1 wherein the bagger includes:

a bag supply mechanism;

a blower fan engaged to open the mouth of the bag to receive the product;

a heat sealer for heat sealing the open mouth of the bag once the bag is filled with the ice.

3. The apparatus of claim 2 wherein the processor includes:

at least one laser switch positioned at specific areas on the apparatus for reading the process at various stages to properly time the sequence of operation and producing information indicative thereof.

4. The apparatus of claim 3 wherein the bags include a signal code containing identifying information and wherein the processor further includes:

means for reading the signal code on the bag ensuring only a select type of bag can be used.

5. The apparatus of claim 4 further comprising:

at least one sensor for reading a signal code on the furnished bags from the bag supply mechanism and producing information indicative thereof means for reading the sensor; and means for storing the information obtained from the laser switch and sensor within the processor, wherein the processor transmits the information to a web page accessible on the internet.

6. A process of bagging ice with an ice bagging apparatus, the process comprising:

making ice;

channeling the ice to a hopper then to a single roller drum mounted along a horizontal longitudinal axis below the hopper;

measuring the amount of ice with the single roller drum, wherein said measuring comprises filling said single roller drum with ice;

supplying a bag via a bag supply mechanism;

rotating the single roller drum about its longitudinal axis once the single roller drum is filled with the desired amount of ice;

controlling the rotation of the single roller drum with a processor so as to align an opening in said single roller drum with a bag to be filled with ice from said single roller drum;

engaging an open mouth of the bag with a blower fan;

blowing the hag open with the blower fan;

dumping the ice into the waiting bag;

heat sealing the bag with a heat seal strip;

automatically rotating the sealed bag into a freezer storage unit.

7. The process of claim 6 further comprising:

placing a plurality of laser switches at specific areas on the apparatus for reading the process at various stages to properly time the sequence of operation;

placing at least one sensor to read a signal code on the furnished bags from a bag supply mechanism in the ice bagging apparatus;

reading the sensor with a processor, said processor being located on the ice bagging apparatus;

storing the information obtained from the laser switches and sensor within the processor transmitting the information to a web page accessible on the internet;

monitoring the information found on the web page by a remote user for ensuring production of ice bags, for reporting, and for regular maintenance.

* * * * *